United States Patent [19]

Iijima et al.

[11] Patent Number: 5,061,443

[45] Date of Patent: Oct. 29, 1991

[54] METHOD AND APPARATUS FOR MICROWAVE STERILIZATION OF AMPULES

[75] Inventors: Kenichi Iijima, Isezaki; Minoru Kudo, Saitama, both of Japan

[73] Assignees: Eisai Co., Ltd., Tokyo; Micro Denshi Co., Ltd., Saitama, both of Japan

[21] Appl. No.: 382,265

[22] Filed: Jul. 20, 1989

[30] Foreign Application Priority Data

Jul. 29, 1988 [JP] Japan ..... 63-189880

[51] Int. Cl.[5] ..... A61L 2/12

[52] U.S. Cl. ..... 422/21; 219/10.55 A; 219/10.55 F; 250/455.1

[58] Field of Search ..... 422/21, 22, 26, 105, 422/107, 109; 250/454.1, 455.1; 219/10.55 A, 10.55 F, 10.55 R; 914/156, 157, 176

[56] References Cited

U.S. PATENT DOCUMENTS

| | | | |
|---|---|---|---|
| 3,674,422 | 5/1970 | Gray | 422/21 |
| 3,737,608 | 6/1973 | Nagao et al. | 422/21 |
| 3,880,586 | 4/1975 | Murayama et al. | 422/21 |
| 3,885,915 | 5/1975 | Utsumi et al. | 422/21 |
| 3,955,286 | 5/1976 | Anrep | 422/21 |
| 4,405,850 | 9/1985 | Edgar | 219/10.55 A |
| 4,599,216 | 7/1986 | Rohrer et al. | 422/21 |

*Primary Examiner*—Robert J. Warden
*Assistant Examiner*—Howard Hampel
*Attorney, Agent, or Firm*—Griffin Branigan & Butler

[57] ABSTRACT

A rectangular waveguide is provided in communication with a microwave generator, and an irradiation furnace formed in its top wall with a slot is provided in communication with the rectangular waveguide. Ampules having only lower portions inserted through the slot into the irradiation furnace are transported by conveyor means along the slot. A depth of the irradiation furnace and/or a distance between the ampules and a surface of the slot may be adjusted to control sterilizing effect for medical fluid filling the ampule.

9 Claims, 9 Drawing Sheets

METHOD AND APPARATUS FOR MICROWAVE STERILIZATION OF AMPULES

BACKGROUND OF THE INVENTION

The present invention relates to method and apparatus for heat sterilization of sealed ampules filled with medical fluid and moving along a slot formed in the upper wall of a microwave irradiation furnace communicating with a rectangular waveguide.

The sealed ampule filled with medical fluid such as an injectable medical fluid is usually subjected to a sterilizing treatment during its manufacturing process and microwave sterilization is well known as one example of said sterilizing treatment.

Such microwave sterilization relies on the phenomenon that medical fluid filling the ampule is heated upon absorption of the microwave energy and this is certainly advantageous in that desired sterilization is achieved in a very short time. However, such well known method of microwave sterilization is disadvantageous in that temperatures within the ampule are apt to become uneven, a trend of temperature rise (temperature rise curve) depends upon a particular type of medical fluid filling the ampule and a gaseous phase within the ampule is apt to be insufficiently heated, resulting in imperfect sterilization.

These Countermeasures are disclosed, for example, by Japanese Disclosure Gazette No. 1973-61609 entitled "Apparatus for sterilization of sealed ampule filled with medical fluid"; Japanese Disclosure Gazette No. 1973-59976 entitled "Apparatus for sterilization of medical fluid within ampule; and Japanese Disclosure Gazette No. 1979-34590 entitled "Method for sterilization within container".

The microwave absorptivity generally depends upon various factors such as the conductivity of the medical fluid and, in addition, the size of the ampule as well as the quantity of medical fluid filling the ampule. Therefore, microwave irradiation under the same conditions, without proper consideration of these factors, might disadvantageously lead to different degrees of temperature rise, depending upon the type of medical fluid and the size of the ampule.

In view of the above possible variables, none of the well known techniques as set forth above has effective adaptability for the temperature rise characteristic, i.e. the temperature rise depending upon the type of medical fluid, and thus none of these techniques achieve uniform sterilization.

More specifically, the apparatus in accordance with the above-mentioned Japanese Disclosure Gazette No. 1973-61609 aims at a uniform temperature rise within the ampule by rotating the ampule which is being held at an appropriate angle with respect to the vertical as the ampule is irradiated with the microwaves. However, the intended temperature rise uniformity is unacceptably limited in spite of a considerably complicated mechanism required for this purpose.

The apparatus well known from the above-mentioned Japanese Disclosure Gazette No. 1973-59976 is claimed to minimize the variable temperature rise within an ampule by irradiating the lower portion of the ampule (held upright) with the microwaves. However, this apparatus also has various problems remaining unsolved due to the simple manner of microwave irradiation. Namely, a low heating efficiency requires the correspondingly long heating furnace as well as a high microwave capacity and makes it impossible to achieve an efficient sterilization.

Moreover, the microwave irradiation performed in such manner causes substantially only the liquid phase of the medical fluid within the ampule to be heated and the unfilled space within the same ampule remains at a lower temperature even after medical fluid has attained a temperature high enough to be sterilized. In other words, germs on the inner wall of said unfilled space are left unsterilized.

Finally, the above-mentioned Japanese Disclosure Gazette No. 1979-34590 proposes a countermeasure of inverting the ampule. However, the mechanism for this purpose is considerably complicated and it is practically difficult for such mechanism to realize continuous processes of sterilization.

Additionally, if conditions of the microwave irradiation are changed according to the type of medical fluid, the speed of the sterilizing process will necessarily vary and accordingly the speed of the medical fluid filling process must be changed. This often results in a repression of production rate.

SUMMARY OF THE INVENTION

In view of the drawbacks as have been indicated with respect to the prior art, an object of the present invention is to provide method and apparatus adapted to sterilize the ampule, using a relatively simplified mechanism, with a heating efficiency adjustable for particularities, depending upon the case, for example, conductivity of particular medical fluid and the size of particular ampule.

Such object is achieved, according to the present invention, by a method for ampule sterilization utilizing microwaves, in which only a lower portion of each ampule is inserted into an irradiation furnace provided in communication with a rectangular waveguide through a slot formed in the top wall of said irradiation furnace and sterilization occurs during movement of the ampule along said slot, said method being characterized by the step of adjusting the depth of said irradiation furnace or a distance between the ampule and a surface of said slot and thereby controlling the exposure dose of said ampule to the microwaves.

Said objects is also achieved, according to the present invention, by an apparatus for ampule sterilization utilizing microwaves including an irradiation furnace provided in communication with a rectangular waveguide and formed in the top wall with a slot and conveyor means adapted to move, along said slot, each ampule having only a lower portion thereof inserted into said irradiation furnace through said slot, said apparatus being characterized by that the depth of said irradiation furnace or the distance between the ampule and the side or surface of said slot is adjustable.

In view of a fact that the unfilled space within ampule is usually prevented from being adequately heated by the microwaves, these method and apparatus may be constructed so that the ampule is subjected to heating by hot blast during movement thereof along the slot.

The rectangular waveguide specified by JIS standards is too large to be used with the irradiation furnace to sterilize the ampules and, therefore, the cross-sectional area of the irradiation furnace is dimensioned according to the present invention so as to be smaller than the cross-sectional area of the rectangular waveguide.

Another object of the present invention is to provide a method allowing an ampule to attain a peak temperature at a predetermined point during a process of ampule sterilization.

This object is achieved, in accordance with the present invention, by method or apparatus adapted to perform the microwave irradiation in a direction reverse to the direction in which the ampules move.

In spite of a relatively simplified mechanism involved, the present invention is extremely useful in practice in that medical fluid filling the ampule can be uniformly sterilized within an irradiation furnace having a high electric field strength. This is done by relating the medical fluid filling the ampule and the types and sizes of ampules. Thus, various fluids and ampules can be flexibly treated because the heating efficiency for sterilization can be adjusted for various factors such as size and shape of the ampule as well as type of medical fluid filling the ampule.

Furthermore, the present invention permits the ampule sterilization to be carried out, by a relatively simplified mechanism, with the heating efficiency being adjustable for the particular medical fluid conductivity and ampule size, and thereby permits an efficient sterilizing treatment to be achieved with a sufficient compatibility with a working speed of the medical fluid filling apparatus.

BRIEF DESCRIPTION OF THE DRAWINGS

The above and other objects of the invention will be seen by reference to the description taken in connection with the accompanying drawings, in which.

DETAILED DESCRIPTION OF THE INVENTION

The present invention will be described, by way of example, in reference with the accompanying drawings.

Figure 1:
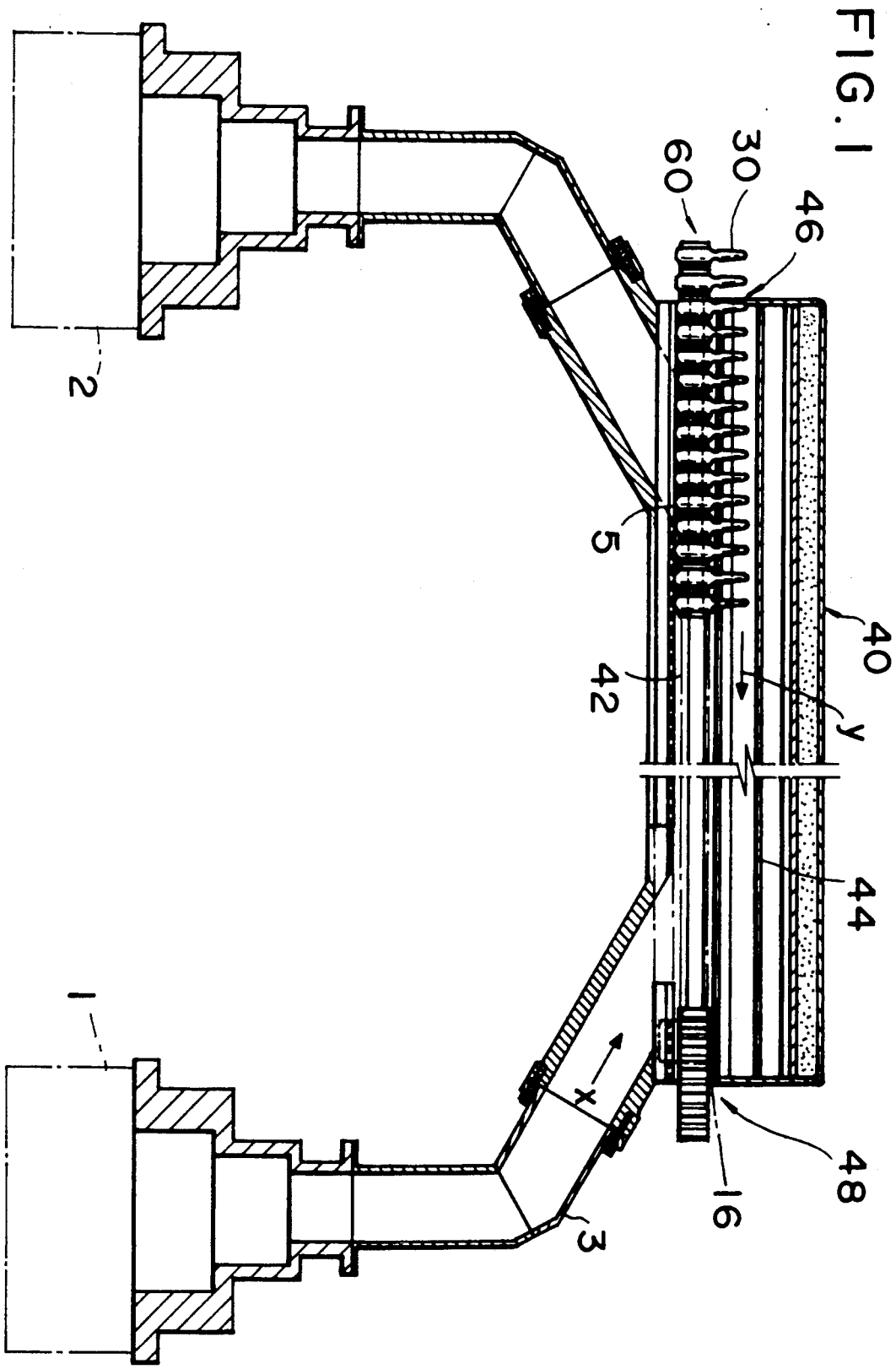
FIG. 1 is a sectional side view showing an embodiment of the sterilizing apparatus constructed in accordance with the present invention.
Figure 2:
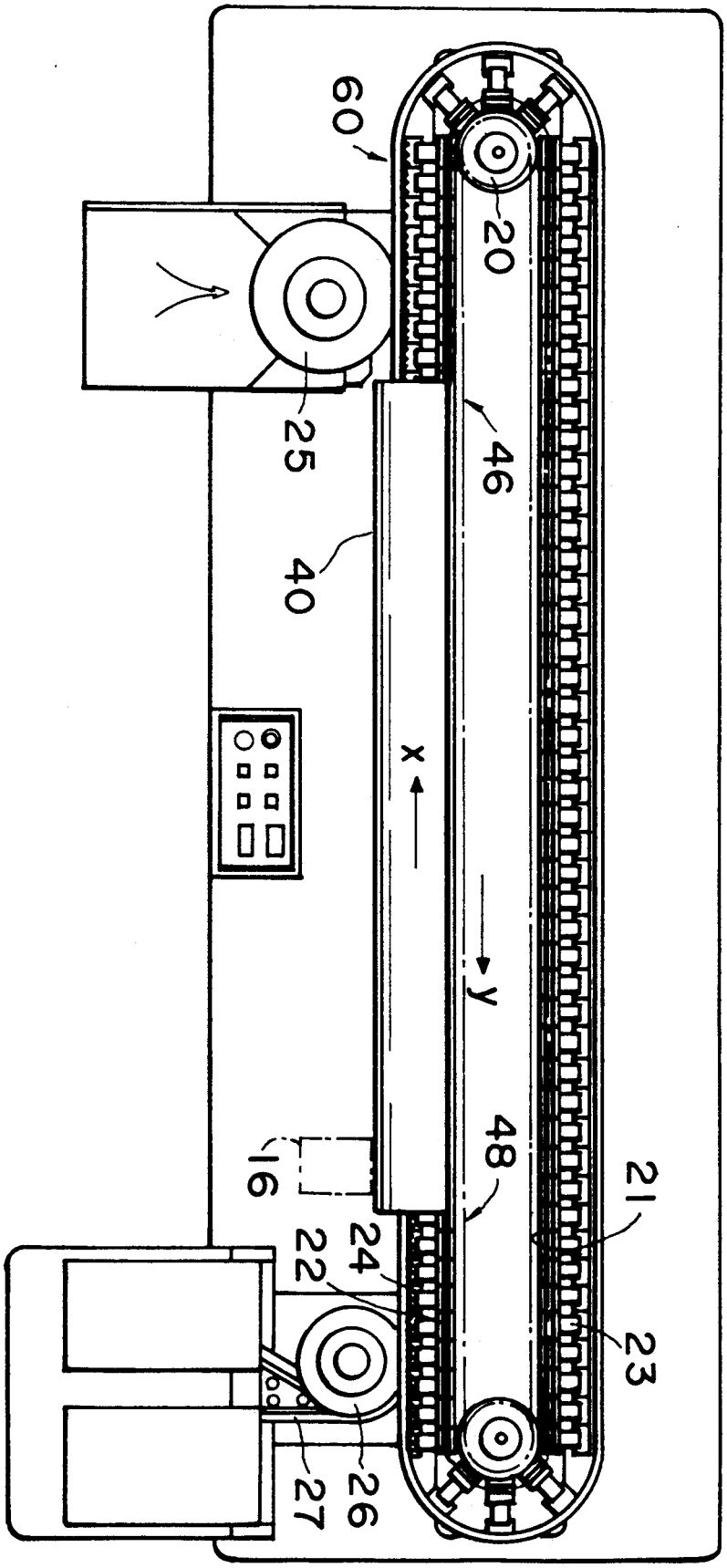
FIG. 2 is a plane view showing the embodiment of FIG. 1.
Figure 3:
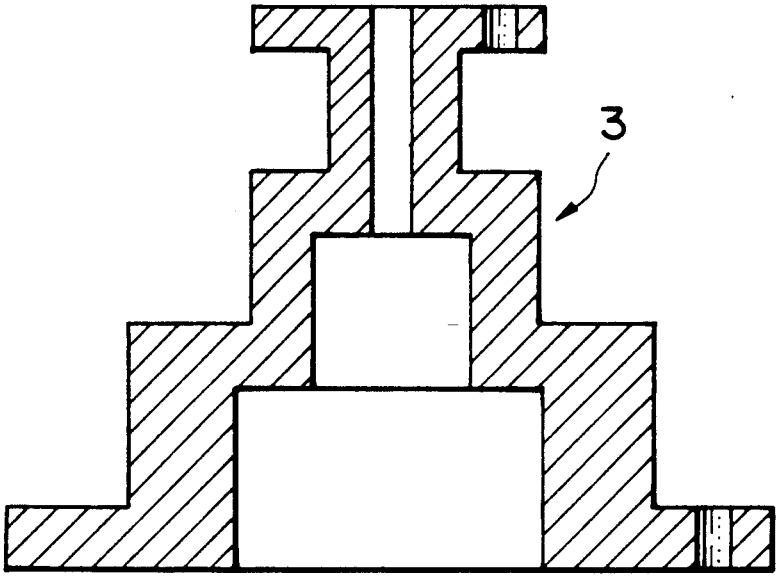
FIG. 3 is a sectional view showing an embodiment where the rectangular waveguide cross-section has been reduced.

FIGS. 1 and 2 illustrate a sterilizing apparatus constructed in accordance with the present invention, which comprises, as important components, a heater section (40) and conveyor means (60) adapted to transport ampules (30) through said heater section (40).

First, the heater section (40) will be discussed with reference to FIG. 1.

Figure 8:
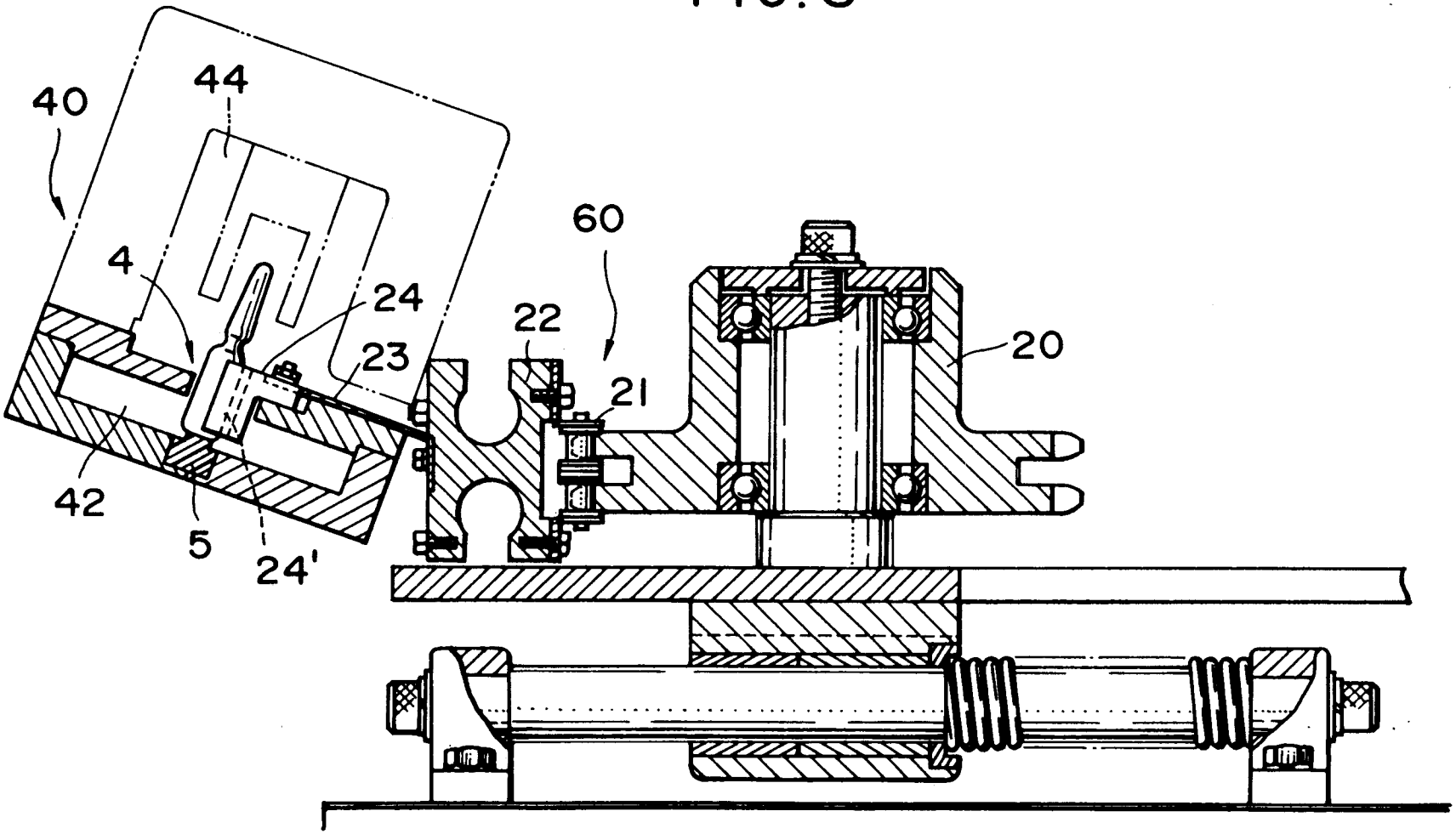
FIG. 8 is a vertical sectional view showing the conveyor means of FIG. 2 in more detail.
Figure 9:
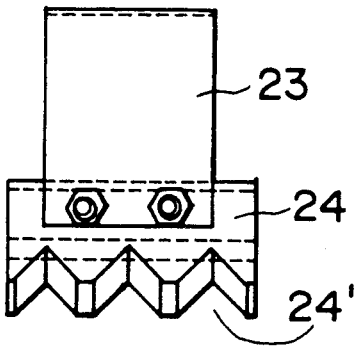
FIG. 9 is a plane view showing the bracket in FIG. 8 in more detail.

The heater section (40) comprises an irradiation furnace (42) formed by reducing a cross-sectional area of a rectangular waveguide (3) provided in communication with a microwave generator (1), on one side, and with a microwaves absorber (2), on the other side, to propagate microwaves from the former to the latter in a direction as indicated by an arrow(x), and a hot blast furnace (44) covering a top of said irradiation furnace (42) from above. It should be understood here that heater section (40) is disposed to be inclined inwardly with respect to the conveyor means (60) at some degrees (in order of 20 degree) from the vertical, as seen in FIG. 8.

Figure 4:
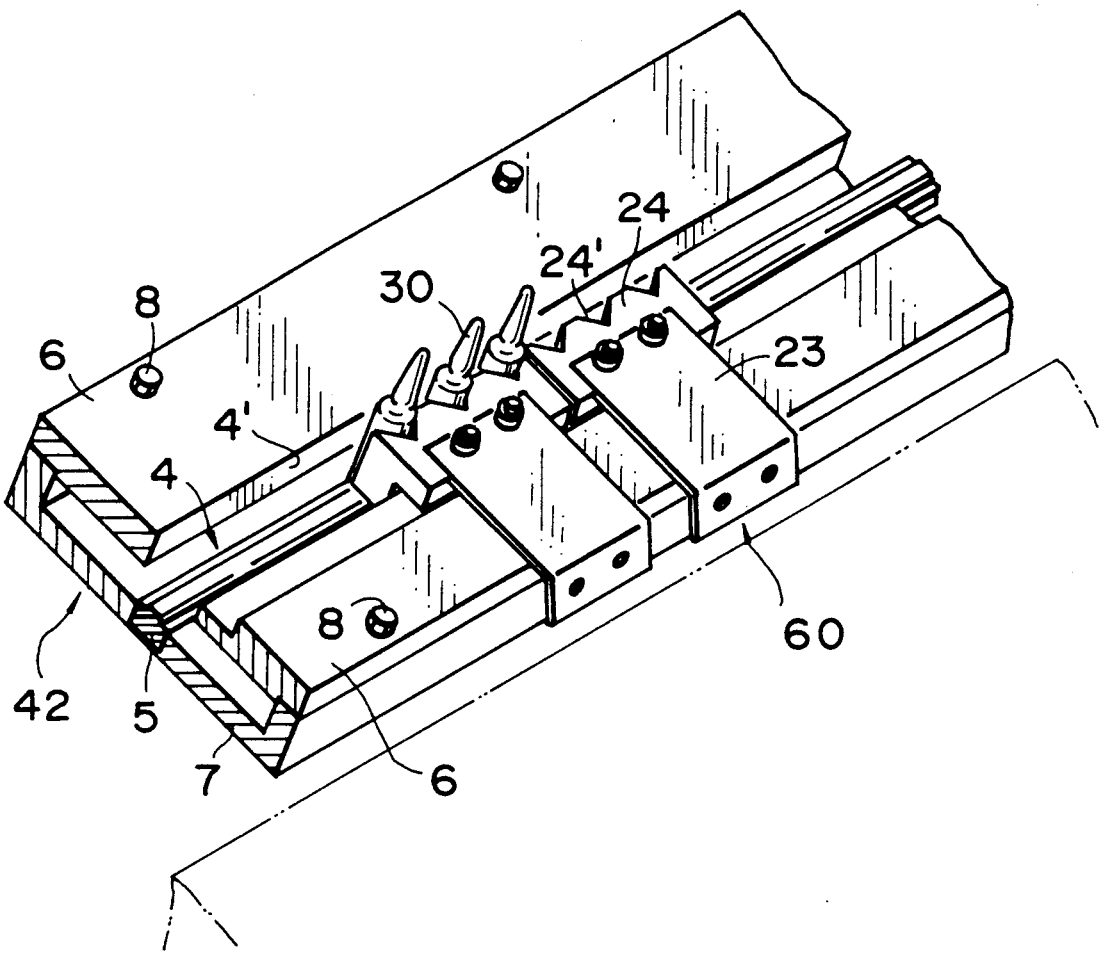
FIG. 4 is a perspective view showing, partially in a section, a part of the irradiation furnace.

As will be apparent from FIG. 4, the irradiation furnace (42) is provided in its upper wall with a slot (4) extending longitudinally of the furnace so that the ampules (30) having only lower portions thereof inserted through the slot (4) into the irradiation furnace (42) may be transported along said slot (4) by the conveyor means (60) which will be described more in detail later. A guide (5) used to support bottoms of the ampules (30) is exchangeable in accordance with a particular height of said ampules (30). A member (6) forming the upper wall of the irradiation furnace (42) is also exchangeable and adapted to be secured to a furnace body (7) by bolts (8). Specifically, the member (6) of selected thickness (6*a*) and width (6*b*) may be exchangeably mounted on the furnace body (7) to adjust a depth (9) of the irradiation furnace (42) as well as a distance (10) between the respective ampules (30) and a surface (4') of the slot (4), as will be apparent from FIGS. 5(A) through 5(C).

Figure 5A:
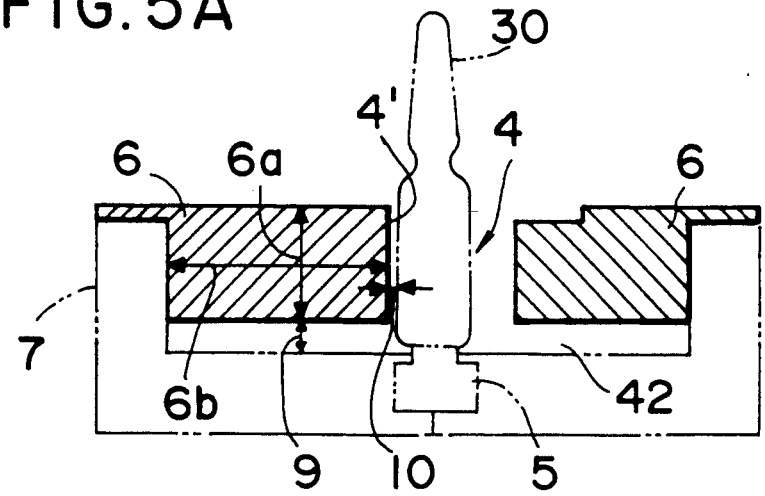
FIGS. 5(A) through 5(C) are respectively fragmentary vertical sectional views of the irradiation furnace.
Figure 5B:
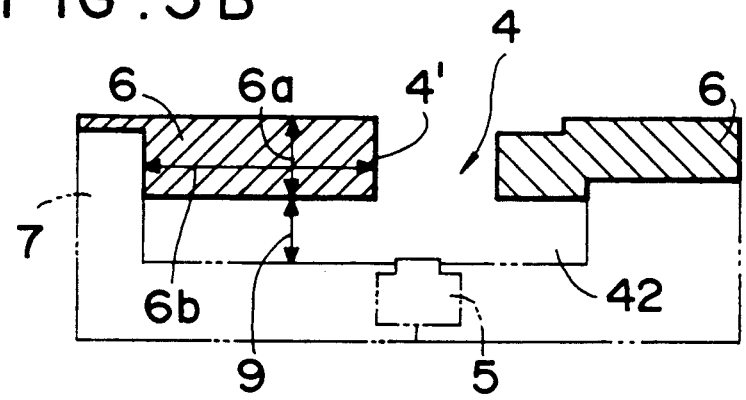
Figure 5C:
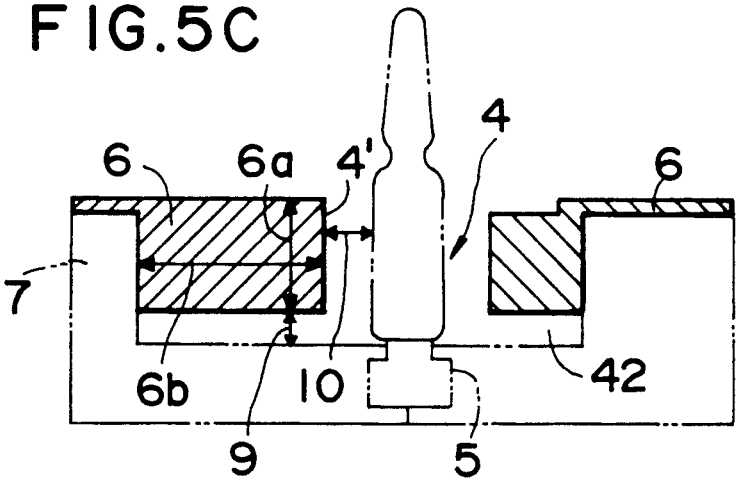

FIG. 5(A) shows a case in which the distance (10) between the respective ampules (30) and the surface (4') of the slot (4) has been adjusted to be relatively narrow, FIG. 5(B) shows another case in which the depth (9) of the irradiation furnace (42) is larger than that in the case of FIG. 5(A), and FIG. 5(C) shows still another case in which the said distance (10) is larger than that in the case of FIG. 5(A).

A cross-sectional area of the irradiation furnace (42) may be dimensioned so as to be smaller than that of the rectangular waveguide (3) to improve a power flux density within the irradiation furnace (42) and correspondingly to improve a heating efficiency. Thus, the effective length of the irradiation furnace can be shortened, making it possible to miniaturize the apparatus as a whole.

Figure 6A:
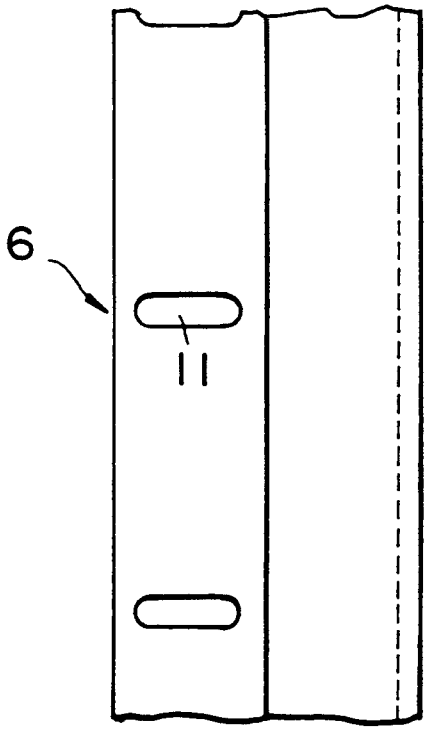
FIGS. 6(A) and 6(B) are plane views respectively showing variants of a member defining the top of the irradiation furnace.
Figure 6B:
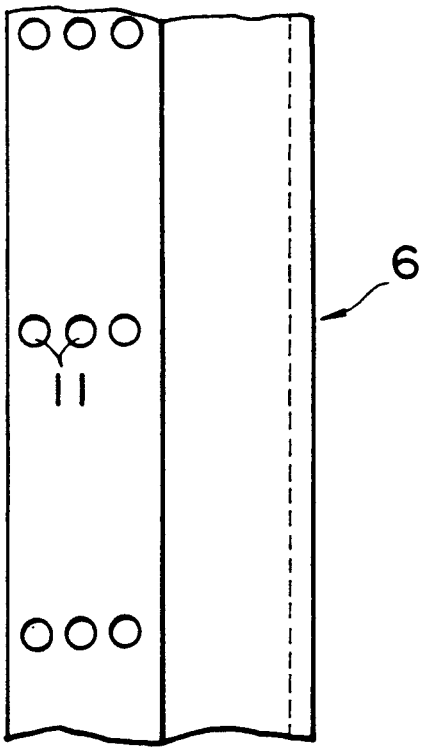

FIG. 6(A) shows a case in which the member (6) is provided with elongate through-holes (11) for the bolts (8) while FIG. 6(B) shows alternative case in which the member (6) is provided with a plurality of through-holes (11) for the bolts (8). In any case, it is possible with the single and same member to adjust the distance between the respective ampules (30) and the surface (4') of the slot (4).

Figure 7:
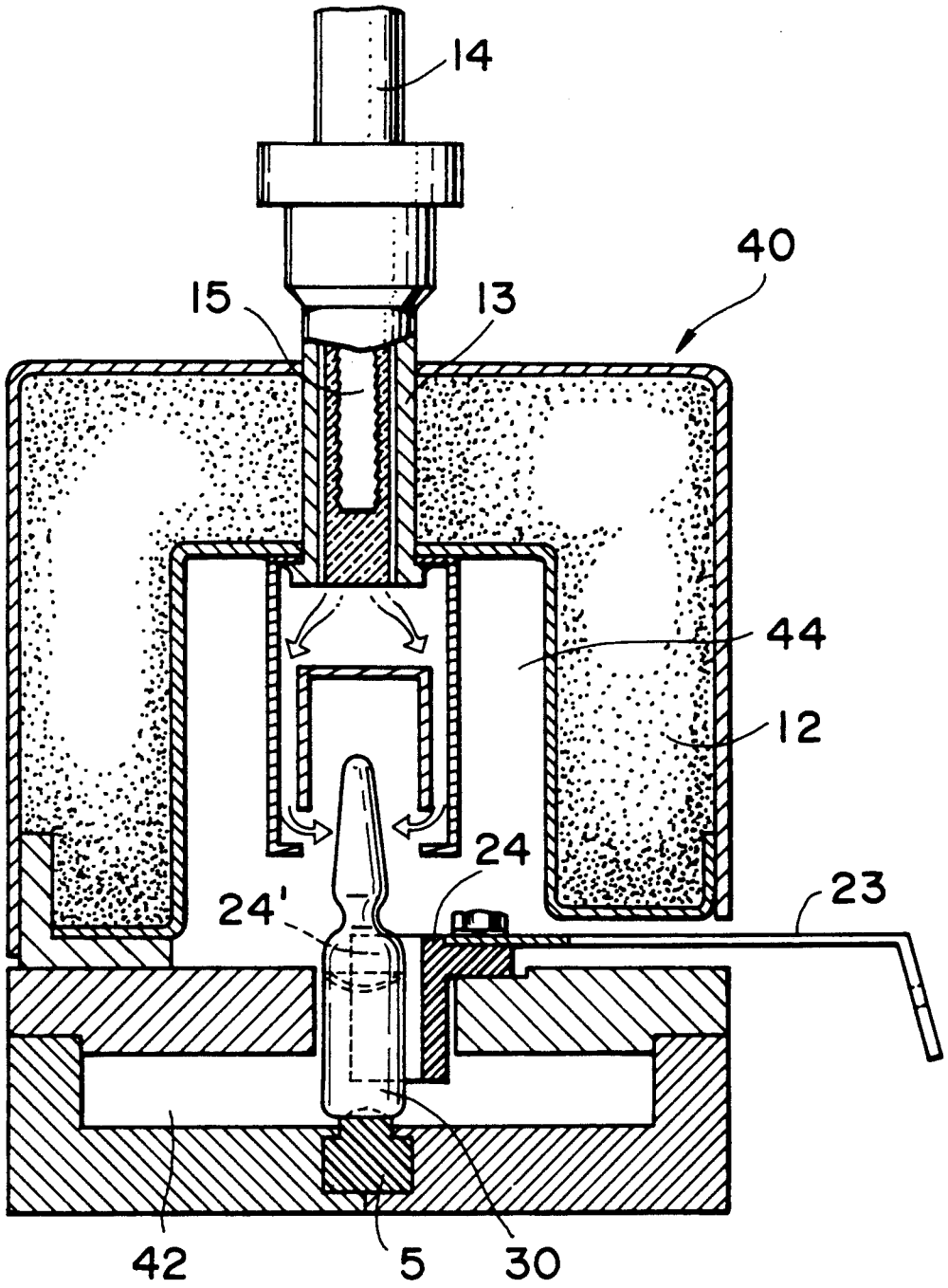
FIG. 7 is a vertical sectional view showing the heater section in FIG. 1, more in detail.

Referring to FIG. 7, the top of the irradiation furnace (42) is covered with the hot blast furnace (44) which is, in turn, isolated by a heat shielding wall (12) filled with suitable thermal insulating material from the exterior.

Reference numeral (13) designates a nozzle adapted to supply the hot blast furnace (44) with hot blast and compressed air supplied through a pipe (14). The air flows then through said nozzle (13) and a heater (15)

disposed therein into the furnace (44) so as to heat upper portions of the respective ampules (30).

Referring again to FIG. 1 there is provided adjacent an outlet (48) of the heater section (40), constructed as has been mentioned, a thermometer (16) such as an infrared radiation thermometer for remotely measuring a temperature of the ampules (30).

Now the conveyor means (60) will be explained.

Referring to FIG. 2, reference numeral (20) designates a pair of sprockets comprising a driver sprocket adapted to be counterclockwise rotatably driven by an electromoter not shown and a follower sprocket.

These sprockets (20) are operatively associated by an endless chain (21) which carries, in turn, conveyor bodies (22), as shown in FIG. 8, and plates (23) extending from the respective conveyor bodies (22) are provided on front ends thereof with brackets (24) to be received by the slot (4). Each bracket (24) is inclined inwardly just as the heater section (40) is, so that the ampules (30) are also correspondingly inclined in the respective notches (24') holding the respective ampules (30) with bottoms thereof bearing against the guide (5). Thus, during conveying the ampules (30) are transported in a direction (y) as the pair of said sprockets (20) are rotated.

Preferably, the brackets (24) are made of material such as fluorocarbon resin, having a low specific inductive capacity and a high heat resistance.

Each conveyor body (22) is formed in top and bottom with grooves, respectively, each having a cylindrical groove bottom. Although not shown here, along linear sections of the chain course, the conveyor bodies (22) are guided by rods extending through these grooves, respectively, and thereby these conveyor bodies (22) can transport the respective ampules (30) held in the respective notches (24') of the individual brackets (24) with high stability.

As shown in FIG. 2, there is provided adjacent the inlet (46) of heater section (40) feeder means (25) to feed the ampules (30) onto the conveyor means (60) while there is provided adjacent the outlet (48) of the heater section (40) take-out means (26) adapted to take the ampules (30) out from the conveyor means (60). Reference numeral (27) designates sorter means adapted to sort the ampules (30) taken out by the take-out means (26) into products of acceptable quantity and products of unacceptable quality.

With the embodiment of the present invention as has been described hereinabove, along the heater section (40), the ampules (30) being transported by the conveyor means (60) are irradiated with microwaves only at the lower portions thereof which are inserted into the irradiation furnace (42) and, as a result, a temperature difference is generated in the medical fluid contained in each ampule (30) between upper and lower portions thereof. Such temperature difference produces a convection in said medical fluid and this convection is utilized to uniformly irradiate with microwaves throughout said medical fluid contained in the ampule (30) during movement thereof together with the conveyor means (60) along the heater section (40).

Concerning the direction in which the ampules (30) are irradiated with the microwaves in the irradiation furnace (42), such irradiation may occur in the same direction as the direction (y) in which the ampules (30) are transported, or in the direction (x), reverse to the direction (y), in which the ampules (30) are transported. However, the microwave irradiation occurring in the direction (x) reverse to the direction (y) in which the ampules (30) are transported has been found to be significantly effective in temperature control for the ampules (30).

Figure 10:
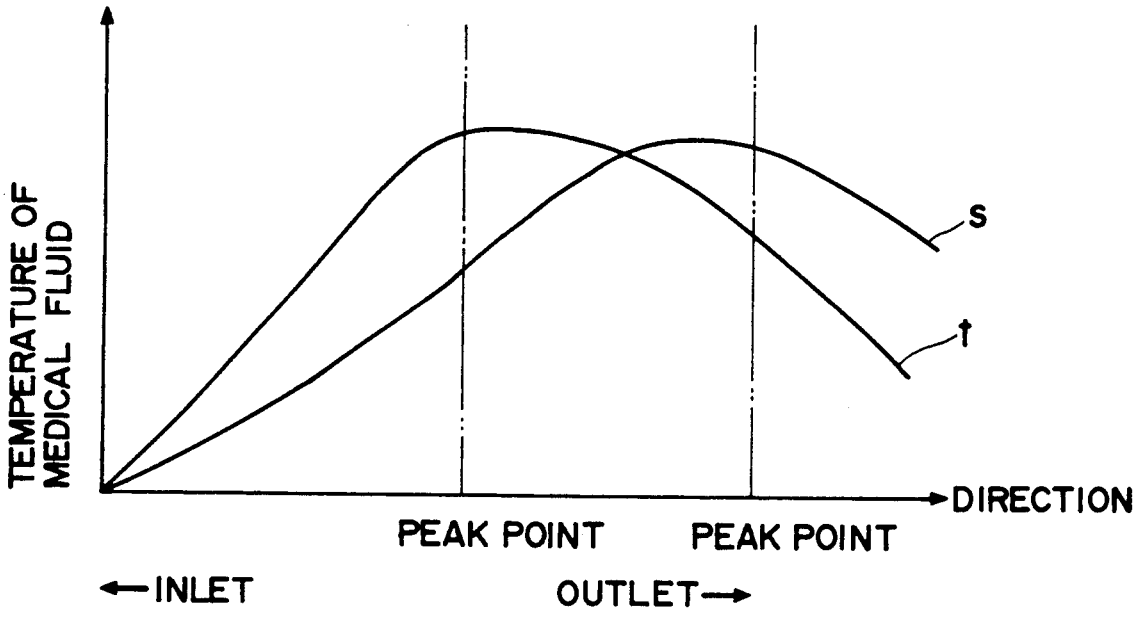
FIG. 10 is a graphic diagram illustrating the temperature rise curve in the forward direction and in the reverse direction with respect to the direction in which the ampule is moved.

FIG. 10 plots how the temperature rise curve varies depending upon whether the microwave irradiation occurs in the same direction as the direction (y) in which the ampules (30) are transported or in the direction (x) reverse to said direction (y).

Specifically, when the microwave irradiation occurs in the direction (x) reverse to the direction (y) in which the ampules (30) are transported, no microwave absorption occurs at the outlet (48) of the irradiation furnace (42) and, as a result, the temperature ceases to rise, so that the temperature rise curve(s) exhibited when the irradiation occurs in the reverse direction attains to its peak as the ampule (30) reaches the outlet (48).

On the contrary, when the microwave irradiation occurs in the same direction as the direction (y) in which the ampules (30) are transported, the peak position on the temperature rise curve (t) exhibited by such irradiation occurring in the forward direction can not be constant, because the point along the irradiation furnace at which the microwave absorption ceases depends upon the particular type of medical fluid filling the ampule. Specifically, the particular type of medical fluid has a conductivity and therefore a temperature rise characteristic peculiar thereto. As an inevitable result, the peak point on the temperature rise curve (t) is variable. Accordingly, it is necessary to change the point along the irradiation furnace at which the peak temperature of medical fluid is to be measured, depending upon the type of medical fluid, and appropriate technical means to achieve this purpose are also required, so far as the microwave irradiation in the forward direction is employed.

In contrast with this, the microwave irradiation in the direction (x) reverse to the direction (y) in which the ampules (30) are transported assures that the temperature rise curve(s) finds its peak point when the ampule (30) reaches the outlet (48) of the irradiation furnace (42). Therefore, the thermometer (16) may be disposed at the outlet (48) to precisely measure the peak temperature and thereby to determine a sterilizing effect through the temperature control.

Another important feature of the method according to the present invention lies in that the depth (9) of the irradiation furnace (42) and/or the distance (10) between the ampule (30) and the surface (4') of the slot (4) may be adjusted to adapt exposure dose as well as strength of the microwaves for the variable factors such as size and shape of the ampule (30) and type of medical fluid.

Figure 11A:
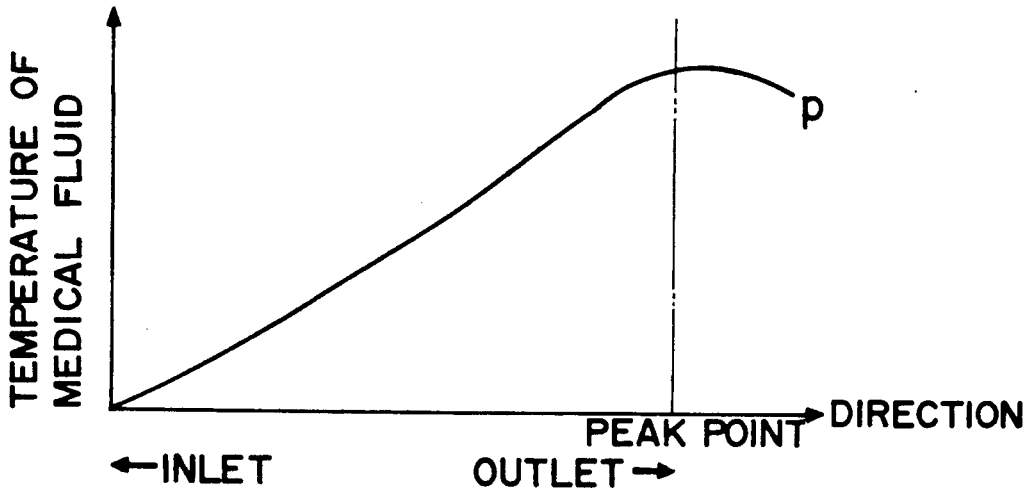
FIGS. 11(A) through 11(C) are graphic diagrams illustrating the temperature rise curve of medical fluid versus the depth of the irradiation furnace and the distance between the ampule and the slot surface.
Figure 11B:
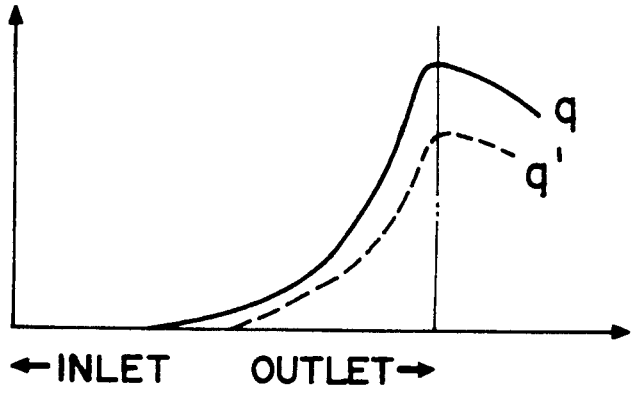
Figure 11C:
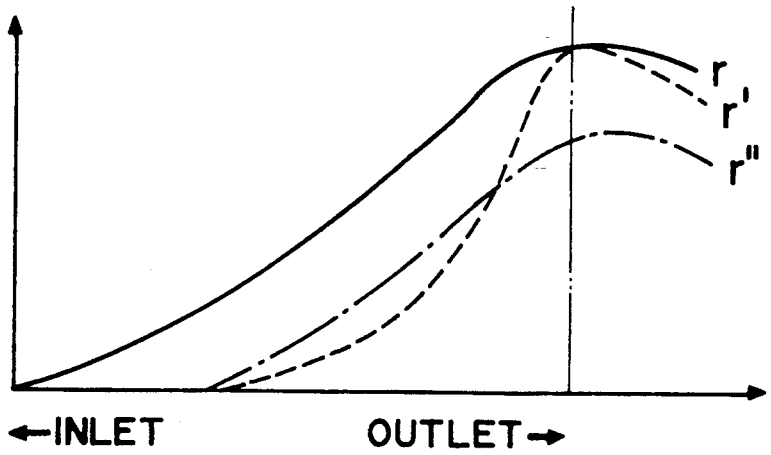

Now it will be considered, in reference with FIG. 11, how the temperature rise curve of medical fluid depends upon the depth (9) of the irradiation furnace (42) as well as the distance (10) between the ampule (30) and the surface (4') of the slot (4). It should be noted here that FIGS. 11(A) through 11(C) illustrate the case in which the microwave irradiation occurs in the direction(x) reverse to the direction(y) in which the ampules (30) are transported.

FIG. 11(A) illustrates a temperature rise curve(p) plotted in connection with medical fluid of the type that is poor in the microwave absorption efficiency. As shown, the curve(p) has a gentle slope between the inlet (46) and the outlet (48) of the irradiation furnace (42) and, therefore, requires no substantial compensation, but it would otherwise be impossible for such medical fluid which is extremely poor in the microwave absorption efficiency to obtain a sufficient peak temperature. In order to overcome this inconvenience, in accordance with the present invention, the depth of the irradiation furnace is selectively changed to adjust a level to which the ampules are inserted through the slot into the irradiation furnace, as shown in FIG. 5(B), and thereby to adjust a microwave irradiation dose to be given to the lower portion of each ampule.

Namely, the depth of the irradiation furnace may be adjusted deeper to increase the surface area of each ampule and thereby to improve the microwave absorption efficiency of particular medical fluid filling this ampule. In this way, said medical fluid which would otherwise be poor in the microwave absorption efficiency can absorb a larger quantity of the microwave and thereby obtain a higher peak temperature.

Then, the case of medical fluid exhibiting a high absorption efficiency will be considered. Substantially whole microwave energy is absorbed by medical fluid as early as at a point adjacent the outlet (48) of the irradiation furnace (42) and substantially no microwave can be propagated to a point adjacent the inlet (42). A temperature rise curve(q) corresponding to such medical fluid exhibits a sharp rise at a point adjacent the outlet (48), as shown in FIG. 11(B). Such a sharp temperature rise leads to an uneven temperature distribution in the medical fluid, makes the sterilizing effect unreliable and sometimes causes the ampules of unacceptable quality. Nevertheless, when the microwave generator is controlled to lower the power level, there is a risk that the peak temperature is correspondingly lowered and the sterilizing effect unacceptably decreases, although a temperature rise curve(q') of more gentle slope is obtained.

To avoid such risk, the distance (10) between the ampule (30) and the surface (4') of the slot (4) may be changed to adjust the strength of the microwaves with which the ampule is irradiated and to make the temperature rise curve gentle. In FIG. 11(C), a temperature rise curve(r') is plotted when the distance (10) between the ampule (30) and the surface (4') of the slot (4) is shortened, as shown by FIG. 5(A), while a temperature rise curve(r'') is plotted when said distance (10) is enlarged, as shown by FIG. 5(C). In the former case, i.e., when said distance (10) is relatively narrow, the peak temperature is raised but the temperature rise curve becomes sharp.

In the latter case, i.e., when said distance (10) is relatively wide, on the contrary, the peak temperature is slightly lowered but the temperature rise curve is gentle. Accordingly, not only said temperature rise curve(r'') may be obtained by enlarging the distance (10) but also the power level may be raised in order to obtain a temperature rise curve similar to the temperature rise curve(r) which is acceptably gentle and exhibits a desired peak.

The temperature rise curve established when the distance (10) has been enlarged, has a slightly lowered peak temperature but a more gentle slope in comparison to the case in which said distance (10) is relatively narrow. This can be explained by the fact that the amount of energy absorbed by each ampule decreases and the microwaves are propagated to a correspondingly larger number of succeeding ampules.

According to the present invention, as will be readily understood from the foregoing description, the depth (9) of the irradiation furnace (42) and/or the distance (10) between the respective ampules (30) and the surface (4') of the slot (4) may be adjustable adapted for the varialbe factors such as size and shape of the ampules (30) as well as particular type of medical fluid filling these ampules (30) to obtain a temperature rise curve presenting a gentle slope and a desired peak temperature. Thus, not only a temperature rise within the ampule become gentle but also a convection within the ampule is gradually generated, advantageously resulting in that the temperature within each ampule becomes uniform and the ampules exhibiting any abnormal temperature rise become few.

Also in accordance with the present invention, upper portions of the respective ampules(30) may be heated by hot blast, as in the previously mentioned embodiment, to heat the unfilled space of each ampule and thereby to sterilize the inner wall of said unfilled space remaining not heated by the microwaves.

Furthermore, the cross-sectional area of the irradiation furnace (42) may be dimensioned so as to be smaller than that of the rectangular waveguide (3) in order that the power flux density within the irradiation furnace (42) is increased and the heating efficiency is correspondingly improved, permitting the irradiation furnace to be shortened and thereby permitting the apparatus as a whole to be miniaturized.

It should be understood that the diameter of the rectangular waveguide (3) may be stepwise reduced in the direction of microwave propagation to increase the power flux density and correspondingly to improve the heating efficiency.

It will be apparent from the foregoing description that, according to the present invention, the depth of the irradiation furnace may be selectively changed and thereby the vertical level to which the ampules are inserted through the slot into the irradiation furnace may be changed to adjust the microwave dose to be given to the lower portion of each ampule, on one hand, and the distance between the ampules and the surface of the slot may be selectively changed to adjust the microwave intensity to which each ampule is exposed, on the other hand.

The feature of this invention that only the lower portion of the respective ampules inserted into the irradiation furnace are irradiated with the microwaves causes a significant differential temperature between the upper and lower portions of the medical fluid in the respective ampules and thereby generates a convection current within the ampules. Such convection current permits the entire amount of medical fluid in the respective ampules to be irradiated with the microwaves and thereby to be uniformly heat sterilized during movement of the ampules along the slot.

Furthermore, the upper portion of each ampule may be heated by hot blast in order to heat the unfilled space within the ampule and to sterilize the inner wall of such unfilled space.

Additionally, the cross-sectioinal area of the irradiation furnace may be proportionally reduced with respect to that of the rectangular waveguide to correspondingly proportionally increase the power flux density and, thus the heating efficiency. This allows, in turn, the irradiation furnace to be shortened.

Moreover, the microwave irradiation may be performed in the direction reverse to that in which the ampules are transported in order to assure that the ampules moving along the slot always cease to absorb the microwaves until the respective ampules reach the outlet of the irradiation furnace and thus exhibit the peak temperature at a constant point along the slot.

While the invention has been particularly shown and described with reference to preferred embodiment thereof, it will be understood by those skilled in the art that the foregoing and other changes in form and details can be made therein without departing from the spirit and scope of the invention.

What is claimed is:

1. In a method for sterilizing fluid contained in ampules by passing the ampules through an elongated microwave irradiation furnace communicating with a microwave rectangular waveguide, and wherein a lower portion of each ampule is inserted through a slot formed along the top wall of the furnace such that the ampules are disposed in the slot at a set depth in the furnace and at a set distance from sides of the slot, and the ampules are transported along the slot and through the furnace so that the ampules are subjected to microwave irradiation at a set exposure dose sufficiently that the fluid in the ampules is sterilized, the improvement comprising, adjusting at least one of said depth in the furnace and said distance from the sides of the slot so as to adjustably control the exposure dose of microwaves to the fluid in the ampules.

2. Method for ampule sterilization according to claim 1, wherein an upper portion of the ampule is heated by hot blast during movement of said ampule along said slot.

3. Method for ampule sterilization according to claim 1, wherein the irradiation furnace has a cross-sectional area smaller than that of the rectangular waveguide.

4. Method for ampule sterilization according to claim 1, wherein the microwave irradiation occurs in the direction reverse to the direction in which the ampules are transported through said furnace.

5. In an apparatus for sterilizing fluid contained in ampules wherein an elongated microwave irradiation furnace communicates with a microwave rectangular wave guide and said furnace has a slot formed along the top wall of the furnace for receiving a lower portion of said ampules such that the ampules are disposed in the slot at a set depth in the furnace and at a set distance from sides of the slot and conveyor means for transporting the ampules along the slot and through the furnace whereby the ampules are subjected to microwave irradiation at a set exposure dose sufficiently that the fluid in the ampules is sterilized, the improvement comprising means for adjusting at least one of said depth in the furnace and said distance from the sides of the slot so that the exposure dose of microwaves to the fluid in the ampules is adjustably controlled.

6. Apparatus for ampule sterilization according to claim 5, wherein a hot blast furnace is disposed above the length of the irradiation furnace such that a hot gas is caused to contact an upper portion of said ampules not disposed in said slot so as to sterilize said upper portion.

7. Apparatus for ampule sterilization according to claim 5, wherein the irradiation furnace has a cross-sectional area smaller than that of the rectangular waveguide.

8. Apparatus for ampule sterilization according to claim 5, wherein the conveyor means is adapted to transport the ampules in the direction reverse to that in which the microwave irradiation occurs in the furnace.

9. Apparatus for ampule sterilization according to claim 5, wherein the conveyor means comprises a plurality of brackets each having a notch for receiving and transporting the ampules through the furnace; and wherein respective ampules are engaged with the respective notches of said brackets in a plane inclined inwardly with respect to the vertical so that the respective ampules are stably engaged with said respective notches.

* * * * *